United States Patent [19]

Shaw

[11] 4,112,688

[45] Sep. 12, 1978

[54] POSITIVE DISPLACEMENT GAS EXPANSION ENGINE WITH LOW TEMPERATURE DIFFERENTIAL

[76] Inventor: John B. Shaw, 1812 E. Marlette, Phoenix, Ariz. 85016

[21] Appl. No.: 731,009

[22] Filed: Oct. 8, 1976

[51] Int. Cl.[2] ..... F01K 11/00

[52] U.S. Cl. ..... 60/669; 417/68

[58] Field of Search ..... 417/68; 60/669, 512, 60/721

[56] References Cited

U.S. PATENT DOCUMENTS

| | | | |
|---|---|---|---|
| 1,611,265 | 12/1926 | Carrey | 417/68 |
| 1,668,532 | 5/1928 | Stewart | 417/68 X |
| 1,843,311 | 2/1932 | Abbott | 417/68 |
| 2,815,003 | 12/1957 | Kumm | 417/68 |
| 3,349,247 | 10/1967 | Birkestrand | 60/669 X |

FOREIGN PATENT DOCUMENTS

| | | | |
|---|---|---|---|
| 865,434 | 5/1941 | France | 417/68 |

*Primary Examiner*—Allen M. Ostrager
*Assistant Examiner*—Stephen F. Husar
*Attorney, Agent, or Firm*—Warren F. B. Lindsley

[57] ABSTRACT

An engine driven by an expanding gas and utilizing a liquid seal in an inexpensive construction which by virtue of the low temperature differential required between inlet and outlet gas is particularly well adapted for use in converting collected solar energy to mechanical or electrical energy. The engine may also be adapted for use as a compressor.

28 Claims, 8 Drawing Figures

POSITIVE DISPLACEMENT GAS EXPANSION ENGINE WITH LOW TEMPERATURE DIFFERENTIAL

BACKGROUND OF THE INVENTION

In recent years, the rapid expansion of the world's population coupled with the accelerated technological development of large sectors of the world has produced a dramatic increase in the demand for energy in all forms including fuels and electricity for heating, lighting, transportation and manufacturing processes. The construction of hydroelectric facilities and the development of fossil fuel resources has continued at a rapid rate, but it becomes increasingly evident for a number of reasons that these efforts are inadequate to keep pace with the demands of the growing population.

One of the more challenging problems to be confronted in the harnessing of a solar energy source is the development of a suitable means for converting thermal energy to mechanical or electrical energy.

The steam turbine is frequently proposed for this purpose, but is not ideally suited for a number of reasons. The first is that it requires high operating temperatures and a high temperature differential from input to exhaust. This imposes difficulties in construction and the high temperatures are difficult to accomplish in a relatively small solar system without sustaining excessive thermal energy losses. The small steam turbine is also inherently inefficient, particularly if it is not operated consistently at optimum conditions of temperature, velocity and load. Furthermore, the construction of a practical steam turbine is too complex and too expensive for all but very high power ratings. Cooling water needs are untenable.

What is needed is a conversion means which is operable at relatively low temperatures and which is efficient over a wide range of operating power levels. It should be simple in construction to permit economy at low power levels and it should offer high reliability and low maintenance.

The typical turbine allows the gas to expand as it ricochets between fixed and revolving sets of blades. The change of directions at each blade causes the kinetic energy of the gas velocity to impart moment to the revolving blades thus creating shaft energy. High vapor velocity and high peripheral blade speeds are required for maximum efficiency. Maximum torque is developed near operating R.P.M. As there is no positive displacement effect, non-productive flow (slip) is approximately inversely proportional to the R.P.M. At stalling speed down to "locked rotor" the "slip" becomes 100%. At stall, a small torque is apparent but no useful work is done, even at full flow.

Multistage turbines having many ranks of fixed and moving blades have a temperature gradient spread over the total path of the vapor. From the superheated inlet to the condenser tubes the greater the $\Delta'$ temperature (difference) the higher the efficiency. Maximum vapor volume and velocity is created by the vacuum of condensation. To take advantage of this increase, the blades of each row are longer and larger in diameter than the preceding row. For maximum economy, the exit vapor from the first stage is often returned to the boiler for re-superheating (to add additional energy for greater velocity and expansion).

Due to the enormous quantity of heat absorbed by the cooling water of the condensers (usually greater than 1,000 BTU per lb. of steam) high efficiency can only be obtained with very high temperatures (1000° F.) and pressures (2500 - 3000 PSI). These are only practicable in super powered plants (larger than 50,000 K.W.). Usually the overall thermal efficiency of these large installations seldom exceed 42% of the total fuel energy converted to electrical power.

SUMMARY OF THE INVENTION

In accordance with the invention claimed, an improved positive displacement engine and energy conversion system is provided with particular applicability in the conversion of solar energy to mechanical and electrical energy at relatively low power levels.

The claimed concept advances the art by eliminating the need for high velocity gas flow to reduce slip by means of a constant volumetric displacement per revolution independent of rotational speed. Sealing liquid in the claimed device is pressurized by centrifugal force which is both the displacement means as well as the main means of adding heat energy to the gas while it is expanding. Friction is virtually eliminated by means of the sealing fluid being in contact with the inside surfaces of the containing and revolving cylinder and traveling at essentially the same velocity. No friction gland seals are required to retain working pressures.

The regenerative heat exchange surfaces rigidly contained within the revolving expansion chambers are heated by immersion in a continuously renewed heated sealing fluid during the contraction of the individual rotating chambers. The chambers are completely filled by this heated sealing liquid and as expansion starts, while the cylinder revolves, the receding liquid interface exposes a heated multi-surfaced mass intimately to the expanding gas tending to offset the drop in temperature due to the $V_1/V_2 = P_2/P_1$ equation, as well as the heat loss of energy conversion.

The essentially adiabatic gas expansion of the typical present day turbine makes less heat energy available for useful work than the claimed device. The claimed device approaches isothermal (constant temperature) gas expansion induced by the heat transfer mass within the rotor cavities and adds a very considerable quantity of heat energy to the expanding gas to increase its volume and pressure to do more useful work per pound of gas.

*The Mechanical Engineers Handbook,* 1930 edition, page 321, Table 19, adiabatic and polytropic expansion, shows the underlined tabulation at 6.5 ($P_1/P_2$ ratio), indicates 5.483 relative volume of the gas expanded to atmospheric at nearly isothermal $N=1.1$ (true isothermal $N=1.0$). By adiabatic expansion from 6.5 indicates the volume to be 3.809. Thus, the volumetric improvement (and work increase) appears to be 5.483/3.809 = 1.4395 or 144%. The claimed device produces a volumetric improvement in the 125–135% range.

In the conventional blade turbine, maximum efficiency is developed over the maximum $\Delta'$ temperature. In thee disclosed invention, maximum efficiency is developed when the internal $\Delta'$ temperature (spread) is nearly zero. Both systems require heat rejection. The blade turbine requires the loss of heat energy of vapor to liquid change, nearly always more than 50% of total E (energy). The claimed device requires less than 50% of the total input energy to be rejected. The work is done by the effective pressure on the rotary vane surfaces. The standard formula for determining the theoretical work available is $(P_1V_1 - P_2V_2)/N\text{-}1$. It is obvious that the lower the value of (N) the greater the mechanical and thermal efficiency.

It is, therefore, one object of this invention to provide an improved positive displacement gas expansion engine.

Another object of this invention is to provide such an engine in a form which is inherently more efficient than the typical steam turbine, particularly when applied or operated at relatively low power levels.

A further object of this invention is to provide such an engine in a form which does not require the high operating temperatures and temperature differentials and pressures associated with steam or gas turbines.

A still further object of this invention is to provide such an engine in which no change of phase is required in the energy transfer medium as, for example, occurs in the case of the Rankine turbine cycle in which water is converted to steam and back again which unavoidable energy losses, and reduced operating efficiency.

A still further object of this invention is to provide such an engine in which long operating life, low maintenance and high reliability are achieved through the use of a liquid seal in contrast to the more common mechanical seals which require close initial manufacturing tolerances and which are subject to wear and subsequent failure.

A still further object of this invention is to provide such a liquid seal in a form which is more efficient in operation than prior art liquid seals, the improved operating efficiency arising from a novel arrangement in which the seal liquid moves in rotation substantially with the adjoining enclosing metal surface and is not cyclically and radically disturbed from its circular flow pattern.

A still further object of this invention is to provide such an engine in which the sealing liquid serves additional functions in acting also as the positive displacement means as well as the medium through which heat energy is added to the expanding gas.

A still further object of this invention is to provide such an engine which may very readily be converted for use as a compressor.

A still further object of this invention is to provide an efficient isothermal gas compressor.

A still further object of this invention is to provide such an engine in a simple and inexpensive construction.

A still further object of this invention is to provide a complete energy conversion system which employs the improved engine of the invention as a key operating element.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawings in which.

DESCRIPTION OF THE PREFERRED EMBODIMENT

Figure 1:
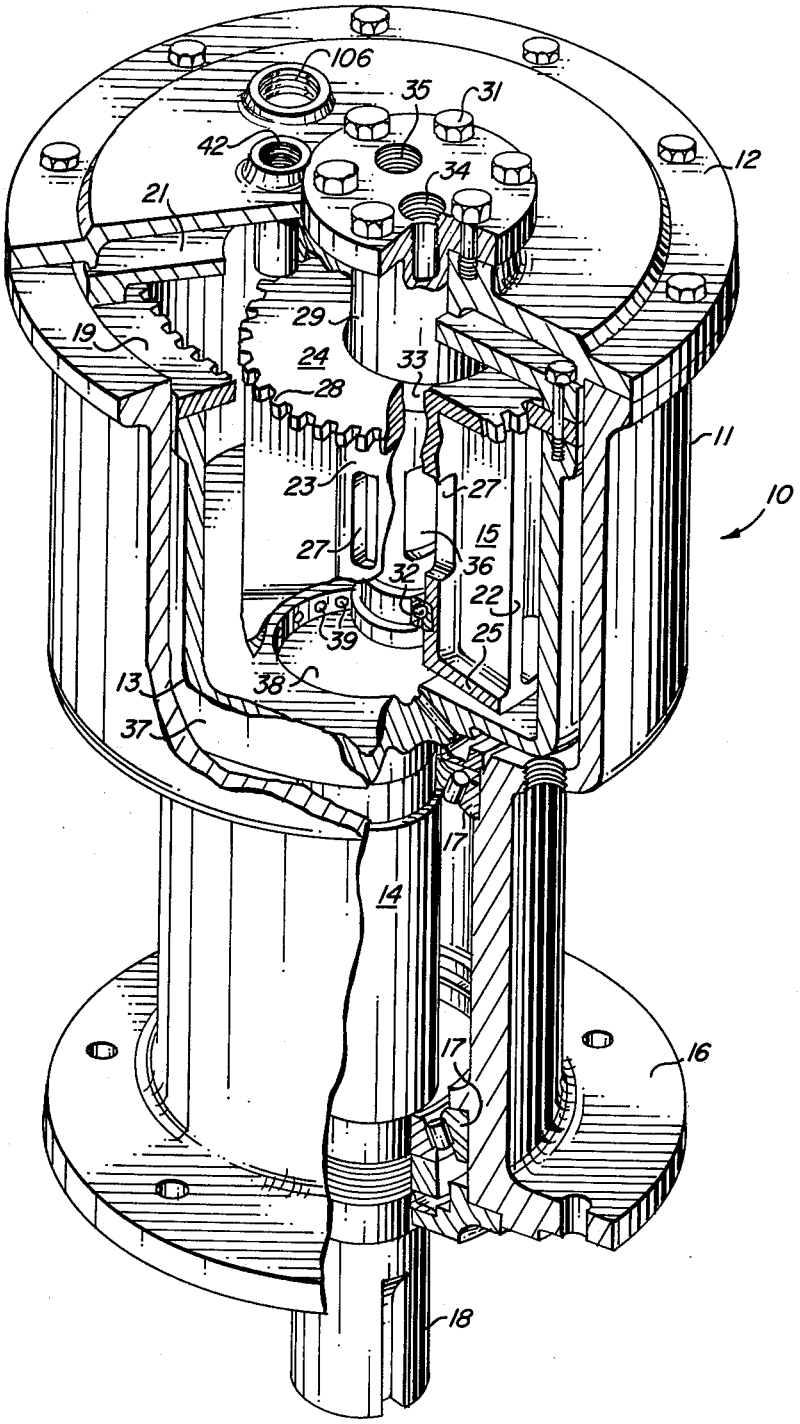
FIG. 1 is a perspective view of the positive displacement gas expansion engine of the invention partially cut away to reveal details of its inner construction.

Referring more particularly to the drawing by characters of reference, FIGS. 1–4 disclose the positive displacement gas expansion engine 10 of the invention, the engine 10 comprising a housing 11 with its end cap 12 enclosing a concentric rotating cylinder or drum 13 and integral downwardly extending shaft 14 and a non-concentrically mounted multi-cavity rotor 15.

The housing 11 comprises a stepped cylindrical structure supported by means of a flange 16 at its lower end. The lower half of housing 11 has a smaller diameter than the upper half. The upper end of housing 11 is flanged to facilitate the securing of cap 12 and may be provided with an inspection opening 106.

Shaft 14 is rotatably supported within housing 11 by means of a pair of spaced journal bearings 17, the first of which is located near the lower end of shaft 14 at the base of housing 11. The second is located near the vertical center of housing 11. The lower end 18 of shaft 14 extends from the lower end of housing 11 and is keyseated for power coupling. The upper end of shaft 14 is integral with the closed lower end of drum 13.

The geometric axis of drum 13 is concentric with the axis of housing 11 and with the axis of shaft 14. An internally toothed ring gear 19 is clamped between the upper open end of drum 13 and a liquid retainer plate 21.

Figure 2:
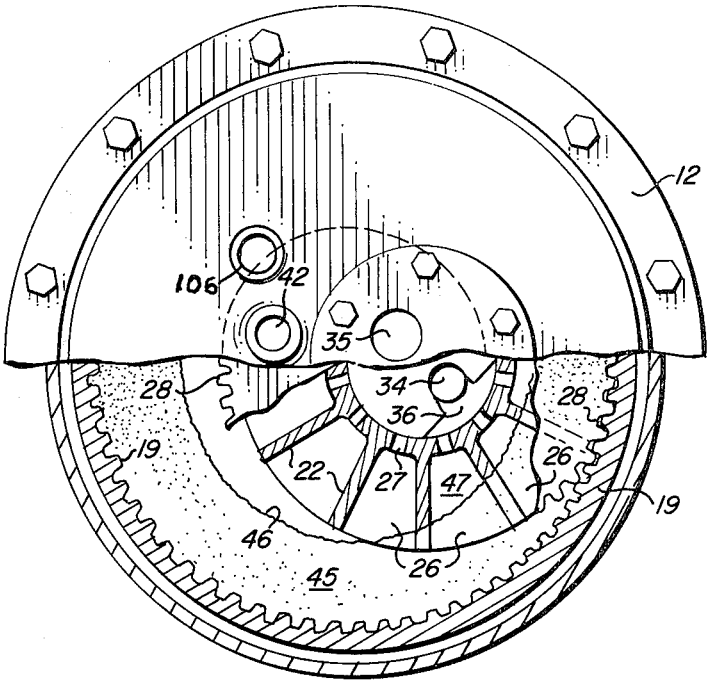
FIG. 2 is a partially cut away end view of the engine of FIG. 1 as seen from a point above the engine.

The rotor 15 has a number of flat rectangular vanes 22 extending radially outward from a vertical hollow cylindrical rotating valving core 23, the vanes 22 being evenly spaced about the circumference of the core 23. Integrally attached to the upper and lower ends of vanes 22 are disc-shaped plates 24 and 25, respectively, the plates 24 and 25 having circular open centers, the inner edges of which are attached to the outer circumference of core 23. The outer circumferences of the plates 24 and 25 extend radially to the radial extremities of the vanes 22 so that between adjacent vanes 22 and within the confines of the plates 24 and 25 are formed a number of cavities 26 opening radially outward about rotor 15 as shown in FIG. 2. The center of each cavity 26 opens into the hollow interior of core 23 through a vertical rectangular slot 27. The outer circumference of plate 24 has machined therein an integral tooth gear 28 which engages ring gear 19 of drum 13, but not limited to this location.

Rotor 15 is supported from cap 12 by means of a ported stub shaft 29. The upper end of shaft 29 is flanged and is anchored rigidly to cap 12 by means of six capscrews 31. Shaft 29 extends downward from cap 12 to a point just above the closed lower end of drum 13. Rotor 15 is rotatably mounted to shaft 29 by means of a locating ball bearing 32 at the lower end of shaft 29 and by a bushing 33 located at the top of rotor 15.

In the arrangement thus far described, the integral structure of shaft 14 and drum 13 are rotatably supported within main housing 11 while rotor 15 is rotatably supported from cap 12, the axis of rotation of drum 13 being parallel but non-concentric with the axis of rotor 15. Toothed plate 24 at the top of rotor 15 has an outer diameter approximately $\frac{1}{3}$ to 4/5 but not limited thereto of the diameter of drum 13 and of ring gear 19 so that as rotor 15 revolves about its own axis and by virtue of the engagement of gears 19 and 28, drum 13 is rotationally driven about its own axis by rotor 15. Because of the smaller diameter of plate 24 and gear 28 relative to the diameters of drum 13 and gear 19, rotor 15 must make approximately three revolutions for each resulting two revolutions of drum 13 so that an approximate 3:2 mechanical advantage is realized.

Shaft 29 is generally cylindrical and is solid except for two longitudinal bores 34 and 35 which extend upwardly from a point near the lower end of shaft 29 through its flared upper end. Where the bores 34 and 35 emerge at the upper end of shaft 29, they are tapped to provide for threaded coupling to gas inlet and outlet lines. The lower end of bore 34 opens through a window or aperture 36 which pierces the wall of shaft 27 on the side facing near but offset from the point of engagement of gears 19 and 28 where it momentarily becomes aligned with slots 27 as they move by with the rotation of rotor 15 about shaft 29. Similarly, bore 35 opens through a second window located opposite window 36 on shaft 29 but not shown in the drawing. The second aperture or window also becomes momentarily aligned with the slots 27 as they pass by on the side of rotor 15 opposite the point of engagement of gears 19 and 28 where there is a large clearance between the circumference of rotor 15 and the inside of drum 13. The exact port locations are determined by design parameters.

Figure 4:
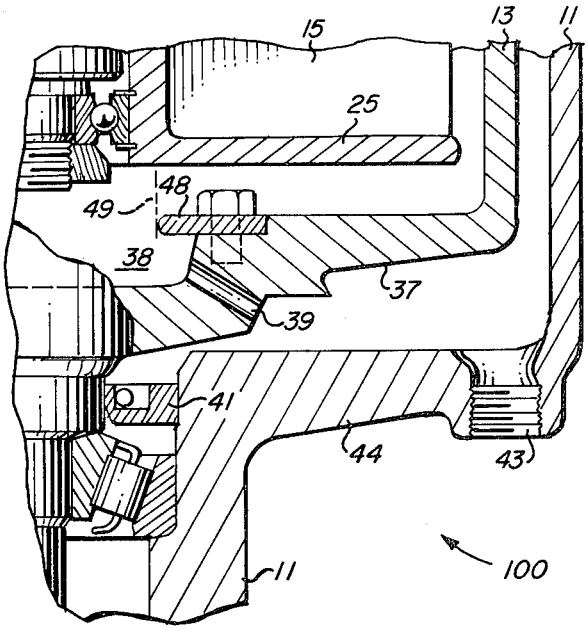
FIG. 4 is a cross-sectional view of a portion of the engine of FIGS. 1–3 showing a means for controlling the level of the sealing liquid retained within the rotating drum of the engine.

The center of base 37 of drum 13 has a circular recession 38 around the periphery of which are spaced a number of holes 39. Holes 39 open into the lower part of the enlarged upper portion of housing 11 as shown most clearly in FIG. 4. A seal 41 functioning between the wall of the housing 11 and the upper end of shaft 14 seals the upper part of housing 11 from its lower part. A fluid inlet 42 shown in FIG. 2 is provided in cap 12 and a fluid outlet 43 shown in FIG. 4 is provided near the outer edge of a shoulder 44 formed at the junction of the upper and lower portions of housing 11.

In the operation of engine 10, the rotating drum 13 is partially filled with a liquid 45 preferably a hydrocarbon compound having a lower vapor pressure forming a liquid piston, which is while rotating, centrifugally disposed outwardly to have a surface 46 that is approximately a constant radial distance from the center of rotation of drum 13. A continuous supply of the liquid 45 is introduced through fluid inlet 42, the excess overflowing through holes 39 at the base of drum 15 and flowing thence through fluid outlet 43.

At the same time, pressurized gas is introduced at the upper end of bore 34, the gas flowing downward through bore 34 and exiting through window 36 and in increments to the passing slots 27 into the revolving cavities 26. The cavities 26 carry the expanding gas to the opposite side of rotor 15 where it then escapes as a fully expanded gas through the slots 27 as they pass the second window in shaft 29 opposite window 36 into bore 35 through which it exhausts upwardly.

The pressurized gas admitted into the cavities 26 through window 36 and the passing slots 27 provides the motive force which rotationally drives rotor 15. The mechanism by which this occurs is most readily understood through an examination of FIG. 2. Of particular significance are the outlines of the gas pocket 47 formed by the unwetted surfaces of the enclosing cavity 26 and the surface 46 of the liquid 45. It is noted that a larger portion of the vane 22 to the left of pocket 47 is exposed to the pressurized gas than is exposed on the vane 22 to the right of pocket 47. A net differential force to the left is thus afforded which produces a motive force for turning rotor 15 in a clockwise direction. As the rotor 15 carries pocket 47 leftward or clockwise from the point of introduction of the pressurized gas, the volume of pocket 47 increases and the pressure tends to decrease inversely. The simultaneous conversion of the thermal energy of the pressurized gas to mechanical rotational energy delivered to rotor 13 also reduces the temperature of the gas in pocket 47.

Counteracting these reductions in pressure and temperature, however, is the introduction of heat into the gas from liquid 45. A constant supply of liquid 45 is introduced at an elevated temperature, the liquid having been heated, for example, by a source of thermal energy such as solar collector. The heated liquid thus introduced through inlet 42 mixes thoroughly with the rotating body of liquid 45 to sustain the temperature of the rotating body of liquid at an elevated level so that a constant transfer of thermal energy occurs from liquid 45 to expanding gas trapped in the rotating cavities 26. This transfer of thermal energy enhances the developed torque by increase of volumetric expansion within rotor 15 and increases the operating efficiency of engine 10.

It will be recognized that liquid 45 serves as the means for sealing cavities 26 in the formation of pockets 47 while it acts simultaneously as the means for injecting supplementary thermal energy into the expanding gas.

It will also be recognized that the centrifugally disposed sealing fluid completely contains the pressure differentials of energy conversion, thus no pressure seals or glands are required to contain liquids or gases. The inspection opening 106 may be uncapped while in operation without significant flow of gas in or out of the cylinder gas space.

A simplified version of this invention will use this opening as a gas inlet or outlet, thus eliminating one port in shaft 29.

Figure 3:
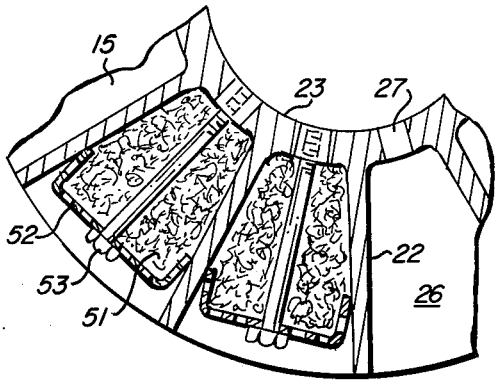
FIG. 3 is an enlarged partial end view of the rotor of the engine of FIGS. 1 and 2 as modified to incorporate special heat transfer masses between the vanes of the rotor.
Figure 3A:
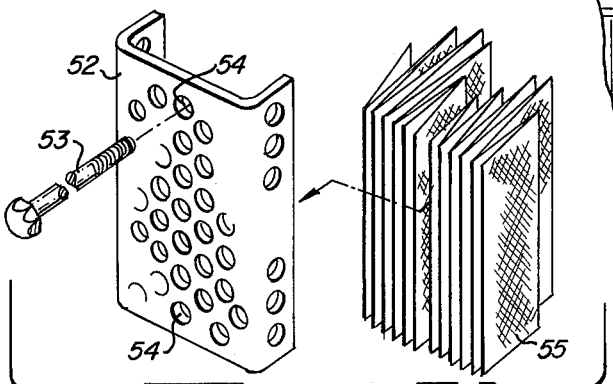
FIG. 3A is an enlarged perspective view of a clamping or retaining means associated with the heat transfer masses of FIG. 3 along with an alternate form of the heat transfer mass.

FIGS. 3 and 3A illustrate an optional means for improving the efficiency of the energy transfer from liquid 45 to the expanding gas. In this variation a heat exchange mass 51 is retained within each of the cavities 26 by means of a perforated channel shaped plate 52 which is secured in position across the opening of the cavity by means of two bolts 53. The bolts 53 pass through holes 54 at the top and bottom center of the plates 52 and thread into aligned holes in core 23 of rotor 15. The heat exchange mass may take the form of metallic wool, or a form of spaced metal screen 55 may be employed as illustrated in FIG. 3A but not limited to this configuration. The greatly increased surface area afforded by mass 51 significantly improves heat transfer from liquid to gas, the mass 51 accepting thermal energy as it is cyclicly immersed in the liquid and releasing it as it is exposed to the expanding gas. The loss in the volume of cavity 26 because of the introduction of mass 51 is insignificant as compared with the improved heat transfer efficiency achieved thereby. The optimum effect which is approached through this means is the achievement of a nearly true isothermal gas expansion. The added heat energy produces a greater volume of expanded gas and causes a grater quantity of energy to be converted into useful work. The overflow liquid from outlet 43 is pumped through a reheater before re-entering the engine at inlet 42.

As indicated earlier, the level 46 of liquid 45 is normally controlled by the position of the overflow holes 39 in the base of drum 13. To alter the liquid level, an optional device in the form of a ring 48 may be attached as shown in FIG. 4 over the periphery of the recession 38 in the base of drum 13. With ring 48 installed, the centrifugally disposed liquid will radially rise to the level 49 as determined by the inner circumference of ring 48. Special sizes of ring 48 may be employed to accommodate variations in operating conditions in the varied application of a basic design of engine 10.

Figure 5:
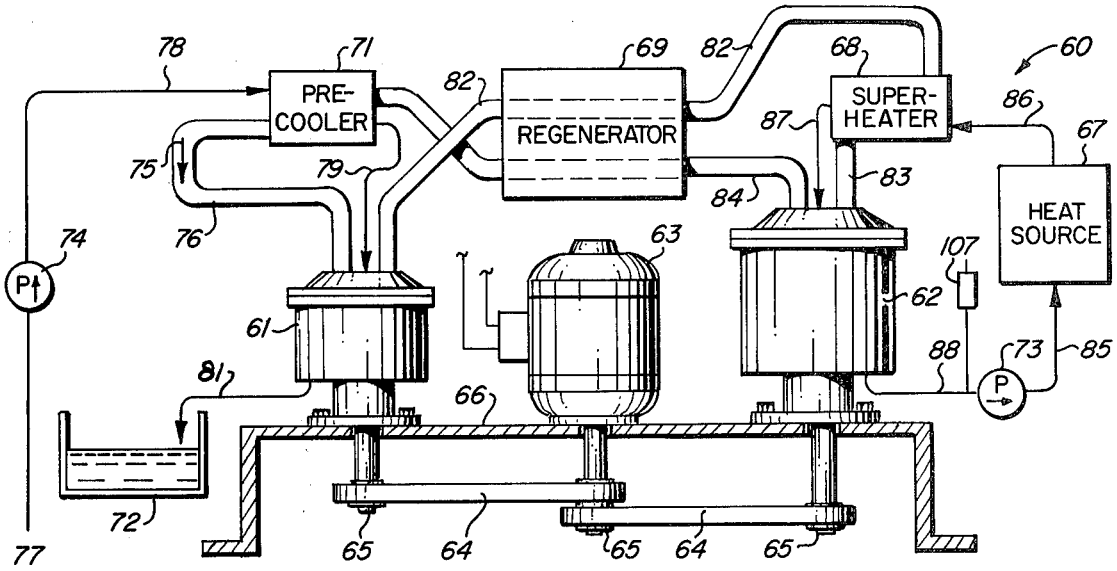
FIG. 5 is a diagrammatic representation of a total energy conversion system incorporating the engine of FIGS. 1–4.

FIG. 5 discloses a complete energy conversion system 60 comprising an isothermal compressor 61, an isothermal expander 62, and a generator 63 mechanically coupled together by belts 64 and pulleys 65, among other means, and supported by a base or platform 66. Auxiliary interconnected elements include a heat source 67, a superheater 68, an optional regenerator heat exchanger 69, a pre-cooler 71, a liquid expansion chamber 107, a sump 72 and pumps 73 and 74.

Expander 62 is engine 10, already described, while compressor 61 is the same device driven backwards as a compressor. Generator 63 is a conventional electric device which may be either AC or DC operated.

In the operation of system 10, expander 62 delivers the motive force for operating generator 63 and compressor 61. An inert gas 75 such as nitrogen is delivered from pre-cooler 71 through line 76 to compressor 61.

Compressor 61 is identical in construction to engine 10 of FIGS. 1–4 and it receives gas 75 through bore 35 as shown in FIGS. 1 and 2. In this case, rotor 15 is forced to turn in a counter-clockwise direction so that gas 75 is trapped in cavities 26 and is compressed as pockets 47 become increasingly smaller with counter-clockwise rotation. Cold liquid from a source 77 is pumped through precooler 71 and through compressor 61 by pump 74, the cooling liquid flowing through pipe line 78 to pre-cooler 71 and thence through line 79 to compressor 61. From compressor 61, the warmed liquid is rejected from outlet 43 (FIG. 2) through line 81 to sump 72. The pre-cooling of gas 75 prior to compression in precooler 71 and inside drum 13 of compressor 61 permits a higher operating efficiency by allowing a higher concentration of gas molecules in the isothermally compressed gas delivered by compressor 61.

From compressor 61, the compressed gas is delivered through line 82 to superheater 68 which comprises a liquid-to-gas heat exchanger. The superheated gas is then delivered at high pressure to expander 62 via line 83.

Expander 62 operates in the manner described for engine 10 of FIGS. 1–4 delivering motive power at its output shaft 14 to drive generator 63 and compressor 61. The depleted gas from expander 62 is delivered via line 84 to the pre-cooler 71 where the sensible residual thermal energy is extracted before return of the gas 75 to compressor 61.

The thermal energy supplied to superheater 68 is carried by a liquid which is heated in source 67 by any appropriate means including, for example, solar energy. The liquid medium is circulated by the pump 73 via line 85 through the source 67, thence via line 86 to superheater 68, from superheater 68 through line 87 to expander 62 and from expander 62 via line 88 back to pump 73. An expansion chamber 107 is provided for fluid make-up. Thermal energy collected by the fluid as it passes through source 67 is released to the gas medium in the superheater 68 and in the expander 62. The mechanical energy developed by expander 62 is thus derived from the thermal energy delivered by source 67 and is more than sufficient to drive compressor 61, the excess being expended in driving generator 63 which delivers the useful output energy of system 60.

An increase in overall efficiency can be obtained by incorporation of the heat exchanger 69 sometimes called a regenerator through which the two gas lines 82 and 84 are passed. In exchanger 69, excess heat from line 84 is transferred to line 82. Part of the residual thermal energy exhausted from expander 62 is thus salvaged by transfer to the compressed gas moving through line 82 to superheater 68 while a part of the cooling burden of pre-cooler 71 is carried by exchanger 69 by virtue of its removal of some heat energy from line 84.

Figure 6:
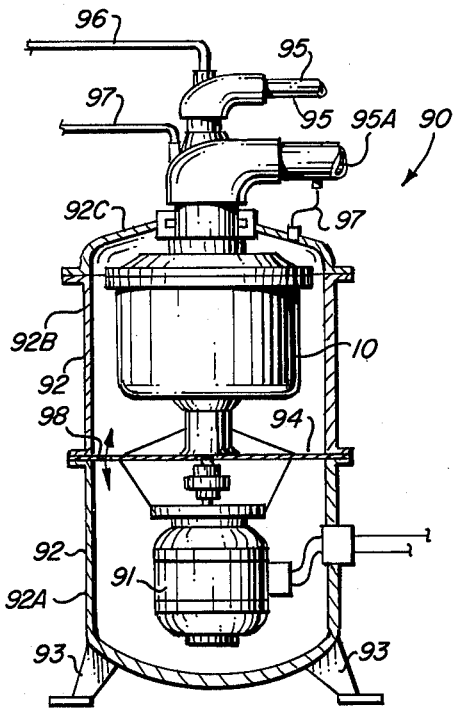
FIG. 6 is a partially cut away view of the engine of the invention coupled to an electric motor or generator inside a pressurized housing or enclosure.

The enclosed and pressurized assembly 90 of FIG. 6 permits economies preferably in the construction of the compressor version of the engine 10 of the invention by obviating the need for pressure glands and revolving seals which are subject to friction, wear, and subsequent failure. Assembly 90 comprises the engine 10 coupled to an electric device 91 with both supported inside a pressurized container or housing 92.

Housing 92 is constructed in three parts including a lower housing 92A, an upper housing 92B and a cap 92C. Lower housing 92A is equipped with mounting feet 93 and is flange coupled to upper housing 92B. Clamped between lower housing 92A and upper housing 92B is a mounting plate 94 which supports engine 10 and motor or generator 91. Upper housing 92B is flange coupled to cap 92C.

Cap 92C is a special construction which supports the rotor shaft 29 of engine 10 and provides integrated sealed entry for gas and liquid lines 95 and 96, respectively.

The containment pressure inside housing 92 is equalized with the internal pressure of engine 10 by connection of a gas line 97 between the low pressure gas line 95A and a port in cap 92C which communicates with the interior of housing 92. A hole 98 in plate 94 provides pressure equalization in lower housing 92A.

Combining engine 10 in series or cascade with pressurized assembly 90 is particularly advantageous in a low pressure and high pressure two or more stage compressor by eliminating the need for pressure rotating glands and seals in the total system.

Figure 7:
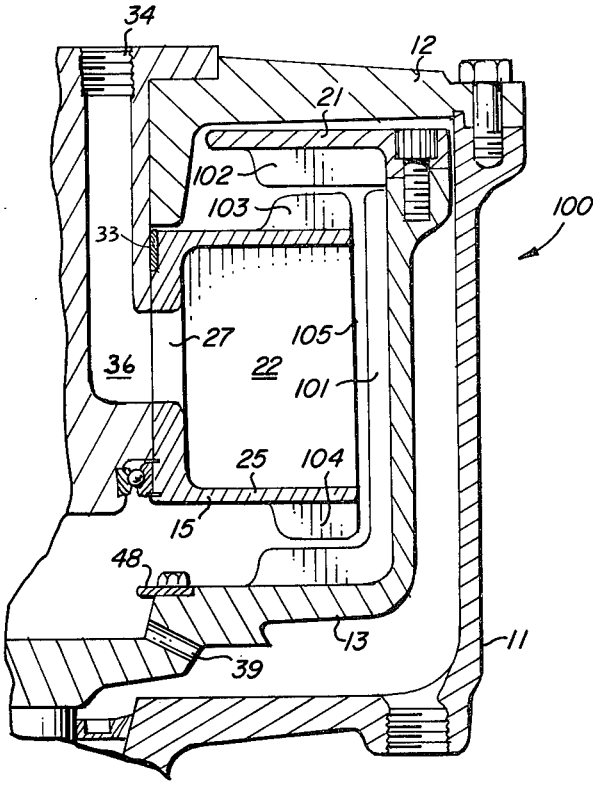
FIG. 7 is a view of a part of the engine of FIGS. 1–4 as modified to incorporate an alternate means for coupling the rotor of the engine to its revolving cylinder.

In a second embodiment 100 of engine 10, as shown in FIG. 7, the gears 19 and 28 are eliminated and replaced by a form of fluid coupling between rotor 15 and drum 13. To effect the fluid coupling a number of fins 101 and 102 with circumferential spacing similar to that of exterior rotor vanes 103 and 104 are added to the inner vertical surface of drum 13. Fins 101 project radially inward from the inner vertical surface of drum 13. They extend vertically from the top to the bottom of the vertical wall of drum 13 and continue radially inward along the top surface of the base of drum 13 from which they project vertically upward toward the under surface of rotor 15. The retainer plate 21 is also fitted with an equal number of fins 102 which are aligned radially with fins 101. Fins 102 project vertically downward and extend a short distance radially inward from a point near the outer periphery of plate 21. In addition to fins 101 and 102 provided on drum 13 as just described, multiple pairs of fins 103 and 104 are added between each location of vanes 22 to the top and bottom surfaces of the rotor 15. For a particular position of rotor 15 relative to drum 13, one of vanes 22 and a pair of associated fins 103 and 104 will be aligned in coplanar relationship with a pair of fins 101 and 102 so that only a small clearance 105 remains between the outer edges of the aligned vanes and fins for the passage of liquid. Relative motion between rotor 15 and drum 13 is thus discouraged by the fluid friction of the liquid and a dynamic form of fluid coupling between rotor 15 and drum 13 is thereby effected. Fluid coupling is, of course, to be preferred to direct gear coupling, especially for ultra high speed operation because it promotes longer operating life and reduced maintenance costs. While a measurable loss in efficiency will be sustained because of slip in the fluid coupling, a part of the loss will be recovered as heat energy collected by the liquid and transferred to the gas.

Although a particular gear type coupling means has been shown and described wherein the gears are arranged at a particular position, it should be recognized as within the scope of this invention to place those gears at any position along the length of the cylinder and rotor whether of integral or separable construction.

A novel and improved expander or engine is thus provided which is readily adaptable for alternate operation as a compressor. In both modes of operation, the invention as described is particularly appropriate for use in a solar energy system in accordance with the stated objects of the invention. The liquid mediums which are employed as a seal in both the engine and the compressor also acts as the medium which delivers supplementary energy to the engine, and reduces work energy to the compressor. In both cases the energy transfer function performed by the liquid enhances the overall operating efficiency. Because the liquid medium travels at substantially the same radial velocity as the containing drum, friction losses between the liquid and drum surfaces are minimized. Further increases in efficiency are introduced by the heat transfer masses incorporated in the rotor cavities.

Although but a few embodiments of the invention have been illustrated and described, it will be apparent to those skilled in the art that various changes and modifications may be made therein without departing from the spirit of the invention or from the scope of the appended claims.

What is claimed is:

1. A device comprising:

a housing, a first shaft journaled for rotation in said housing and having provisions for a power connection at one end thereof, the other end of said first shaft forming a hollow cylinder arranged within said housing, a ducted second shaft affixed to said housing for extending into said cylinder, a multi-cavity rotor arranged within said cylinder and journaled on said second shaft, the longitudinal axis of rotation of said rotor being offset from and parallel with the axis of rotation of said cylinder, said rotor comprising a hollow cylindrical core having a plurality of spacedly radially positioned vanes arranged around said core forming a plurality of cavities one arranged between every pair of said vanes, fixed heat exchange means positioned within said rotor cavities for transferring heat retained thereby, coupling means arranged between said rotor and said cylinder for causing one to rotate the other, a plurality of openings radially formed around said core each providing a slot from the hollow interior of said core into a different one of each of said cavities, said second shaft being provided with a plurality of ports extending from its ducted interior through its outer periphery for sequential alignment with some of the openings in said core, whereby when liquid is placed within said cylinder and at least in some of said cavities of said rotor, a centrifugally disposed sealing means is provided between the inside of said cylinder and said cavities of said rotor upon rotation thereof, inlet means for conducting a gas through said core and thence sequentially through said openings and into said cavities where a differential rotation force is manifested, and outlet means for exhausting said gas.

2. The device set forth in claim 1 wherein:

the differential rotation force comprises an essentially isothermally expanding pressure force causing rotation of said rotor and cylinder and then exhausting at a lower pressure through said outlet means.

3. The device set forth in claim 1 wherein:

essentially isothermal compression occurs upon rotation of said rotor with exhaustion of said gas at a higher pressure through said core and through the ported second shaft.

4. The device set forth in claim 1 in further combination with:

a circulating liquid means from an external source carried within said cylinder and at least some of said cavities of said rotor for providing a centrifugally disposed sealing and heat transfer means between the inside periphery of said cylinder and into the openings of said cavities of said rotor upon rotation thereof.

5. The device set forth in claim 4 in further combination with:

second inlet and independently variable outlet port means to the hollow interior of said cylinder for circulating the sealing and heat transfer liquid means through said cylinder from the external source and retaining predetermined quantities of said liquid means in said cylinder to obtain a substantially isothermal condition during a change in gas pressure.

6. The device set forth in claim 1 wherein:

fixed heat exchange means positioned within said rotor cavities transfers heat retained thereby from a previous immersion cycle of operation to the expanding gases in the associated cavity.

7. The device set forth in claim 1 wherein:

said fixed heat exchange means positioned within said rotor cavities withdraws the heat of compression deposited on said heat exchange means during a following immersion cycle of operation from the compressing gases in the associated cavities.

8. The device set forth in claim 1 wherein:

said heat exchange means comprises shredded metallic means.

9. The gas expansion device set forth in claim 1 wherein:

said heat exchange means comprises metal plates.

10. The device set forth in claim 5 in further combination with:

means for heating externally of said device said sealing and heat transfer liquid means.

11. The device set forth in claim 5 in further combination with:

means for cooling externally of said device said sealing and heat transfer liquid means.

12. The device set forth in claim 1 in combination with:

a mechanically coupled rotating electrical device both contained within a static sealed container whose internal pressure is determined by connection to the lower pressured one of said ports.

13. The device set forth in claim 1 wherein said rotor has a constant volumetric displacement per revolution substantially independent of rotational speed.

14. The energy conversion device set forth in claim 4 wherein:

the pressure differentials of substantially isothermal energy conversion are entirely contained within the centrifugally disposed volume of the sealing and heat transfer liquid.

15. The device set forth in claim 1 wherein:

said heat exchange means in said cavities effect an essentially isothermal change in gas pressure in the associated cavity.

16. A device comprising:

a housing, a first shaft journaled for rotation in said housing and having provisions for a mechanical power connection, said first shaft being attached to a hollow cylinder arranged within said housing, a second shaft affixed to said housing for extending into said cylinder, a closed end vane rotor arranged within said cylinder and journaled on said second shaft, the longitudinal axis of rotation of said rotor being offset from the axis of rotation of said cylinder, said rotor comprising a hollow cylindrical core having a plurality of spacedly radially positioned vanes arranged around said core, said vanes forming a plurality of cavities one arranged between every pair of said vanes, said cavities containing multiple fixed heat exchange surfaces, coupling means arranged between said rotor and said cylinder for causing joint rotation thereof, a plurality of openings radially formed around said core each providing an inlet slot from the hollow interior of said core into a different one of said cavities, said second shaft being provided with inlet and outlet ports sequentially aligned with some of the openings in said core, whereby when liquid is placed within said cylinder and at least some of said cavities of said rotor, a centrifugally disposed sealing and heat transfer fluid is provided between the inside periphery of said cylinder and said cavities of said rotor upon rotation thereof, and passages for conducting a gas through said second shaft inlet port and thence sequentially through said openings and into said cavities where a differential pressure force is manifested involving rotation of said rotor and said cylinder and then exhausting through said outlet port of said second shaft.

17. A method of utilizing a pressure differential comprising the steps of:

injecting a first fluid under pressure into a multicavity rotor having fixed heat exchange surfaces therein, rotating said rotor within a hollow rotating cylinder around an axis offset from the axis of rotation of said cylinder, and temporarily retaining said first fluid within the cavities of said rotor by a second fluid centrifugally positioned in said rotating cylinder and forming a liquid heat transfer and seal between the opening of the cavities and the interior of said cylinder, said first fluid changing its temperature and pressure conditions substantially isothermally during rotation of said rotor.

18. The method set forth in claim 17 wherein:

said first fluid is expanded in the cavities of said rotor causing said rotor to rotate.

19. The method set forth in claim 17 wherein:

said first fluid is compressed within the cavities when said rotor is rotated.

20. The method set forth in claim 18 in further combination with the step of:

transferring heat from said second fluid to said first fluid during the expansion of said first fluid in the cavities of the rotor.

21. The method set forth in claim 19 in further combination with the step of:

transferring heat from said first fluid to said second fluid during the compression of said first fluid in the cavities of the rotor.

22. The method set forth in claim 17 wherein:

said rotor rotates said cylinder.

23. The method set forth in claim 17 in further combination with the step of:

variably controlling the momentarily retained volume of the continuously flowing sealing and heat transfer liquid within said cylinder while it is rotating.

24. In an energy conversion device the combination comprising:

a supporting frame containing journal bearings for a power shaft rotating a hollow cylinder, said cylinder containing a centrifugally disposed sealing liquid, said cylinder being fluid coupled to a closed end vane rotor containing fixed heat exchanging surfaces, said rotor revolving on an offset pivot within said cylinder but affixed to said frame, said pivot providing inlet and outlet ports therein for valving a displacement gas flow in the cavities of said rotor.

25. The energy conversion device set forth in claim 24 wherein:

a continuous flow of said sealing liquid is transmitted into one end of said cylinder and out the other end for maintaining a nearly isothermal gas condition during a change in pressure within the cavities of said rotor.

26. In a constant displacement heat engine comprising:

a power shaft, a rotatable valving core, a plurality of radial cavities formed on said core and containing therein fixed heat exchange surfaces, a rotating casing having an axis eccentric to the axis of said core, a liquid piston partially filling and rotating with said casing, means for introducing a gas into successive cavities to effect a nearly isothermal change of state during rotation, and means for exhausting said gas from said cavities after the performance of shaft work within said cavities.

27. A device comprising a rotor having a plurality of radial cavities containing multiple heat transfer surfaces mounted for rotation on a fixed first hollow shaft positioned parallel to and spaced from a second shaft, a rotatable casing journaled on said second shaft and eccentrically enclosing said radial cavities, the combination comprising:

a circulated heat transfer liquid piston temporarily contained and flowing through said casing for effecting a change of pressure within said cavities, valve ports in said first shaft, and a gas introduced and exhausted through said ports and cavities at a nearly uniform temperature to perform work through an external shaft.

28. The method of causing rotational motion of a cavitied rotor within a liquid enclosing rotating cylinder wherein the cavities contain therein fixed heat exchange surfaces, the step comprising:

introducing a steady flow of gas and heat transfer liquid sequentially into the cavities around the heat exchange surfaces to effect a nearly isothermal change of state of said gas during rotation of said cylinder and said rotor.

* * * * *